United States Patent [19]

Shibano

[11] Patent Number: 5,013,262

[45] Date of Patent: May 7, 1991

[54] MULTI-CONTACT SOCKET

[75] Inventor: Yasuji Shibano, Izumisano, Japan

[73] Assignee: Hosiden Electronics Co., Ltd., Osaka, Japan

[21] Appl. No.: 540,768

[22] Filed: Jun. 20, 1990

[30] Foreign Application Priority Data

Jun. 26, 1989 [JP] Japan ..... 1-75410[U]

[51] Int. Cl.[5] ..... H01R 9/03

[52] U.S. Cl. ..... 439/610

[58] Field of Search ..... 439/607, 609, 610, 744, 439/746, 747, 871, 872, 680, 681

[56] References Cited

U.S. PATENT DOCUMENTS

| | | | |
|---|---|---|---|
| 4,611,878 | 9/1986 | Hall et al. | 439/680 X |
| 4,790,763 | 12/1988 | Weber et al. | 439/681 X |
| 4,810,210 | 3/1989 | Komatsu | 439/610 |
| 4,875,872 | 10/1989 | Tanaka | 439/607 X |
| 4,894,026 | 1/1990 | Dixon et al. | 439/609 |
| 4,908,335 | 3/1990 | Cosmos et al. | 439/79 |

*Primary Examiner*—Larry I. Schwartz
*Assistant Examiner*—Julie R. Daulton
*Attorney, Agent, or Firm*—Pollock, VandeSande and Priddy

[57] ABSTRACT

The rear portion of a rectangular body of an insulating material is made hollow, and the forward portion of the body has contact housing holes extending from the front thereof to the hollow and arranged in a matrix form in the front thereof, socket contacts being housed in the contact housing holes. The rear end portions of the socket contacts are bent at right angles in the hollow and led out of the body through terminal insertion holes of a holder which forms the bottom of the hollow. The rectangular body is fitted in a square tubular shield cover produced by punching a metal plate, pressing and bending it into the desired shape. The body and the shield cover define therebetween a square groove for receiving a metal cover of the mating plug. The top panel of the shield cover has an engaging key protruding outwardly therefrom, and the key has in its top an inward protrusion for locking use.

6 Claims, 4 Drawing Sheets

MULTI-CONTACT SOCKET

BACKGROUND OF THE INVENTION

The present invention relates to a multi-contact socket which has a relatively large number of contacts, and more particularly, to a multi-contact socket which has an electromagnetic shield.

FIG. 1 is a diagram showing, partly in section, the construction of a conventional multi-contact socket disclosed in U.S. Pat. No. 4,810,210, for example. A square body 10 made of an insulating material has a plurality of contact housing holes 12 arranged in a matrix form, in which a plurality of socket contacts 14 are housed. The rear half portion of the body 10 has a hollow 13, which is open at its rear end but bottomed with a terminal holder 20. A terminal of each socket contact 14 is bent down at right angles in the hollow portion 13 and projects out of the body 10 through the corresponding one of holes 25 made in the holder 20. The body 10 is covered over its top, both sides and underside, except the holder 20, with a square tubular metal shield cover 30, which is, in turn, covered, except the holder 20, with a square tubular case 53 of an insulating material. In the front half portion of the socket there is formed a square groove between the case 53 and the shield cover 30, for receiving the front end portion of a square tubular metal cover 70 of the mating plug.

The multi-contact socket shown in FIG. 1 is mounted on a printed circuit board (not shown) with fitting legs 43 of the cover 30 and the terminals 15 inserted in through holes of the printed circuit board and with the front marginal portion of the socket received in a hole 61 made in a metal side wall 60 forming a part of an electronic equipment housing. When the mating multi-contact plug disclosed in the aforementioned United States patent is connected to the above multi-contact socket, the front portion of a square tubular metal cover 70 of the plug is inserted into the groove 51 of the multi-contact socket from the outside of the electronic equipment housing, i.e. from the left-hand side of the side wall 60 in FIG. 1. In such a state the top, bottom and both side panels of the shield cover 30 overlap and make direct contact with the corresponding panels of the metal cover 70 of the mating plug, but since the metal cover 70 inserted in the groove 51 is received inside the socket case 53, neither the shield cover 30 nor the metal cover 70 makes direct contact with the side wall 60 of the electronic equipment housing, and since the side wall 60 has a window for electromagnetic noise of a size corresponding to the thickness D of the wall of the case 53, electromagnetic shielding is incomplete between the inside and outside of the side wall 60 of the housing. The conventional multi-contact socket, when thus mounted on electronic equipment, is defective in that shielding of the electronic equipment against electromagnetic interference is not satisfactory.

SUMMARY OF THE INVENTION

It is therefore an object of the present invention to provide a multi-contact socket which permits excellent shielding against electromagnetic interference when mounted on electronic equipment.

In the multi-contact socket of the present invention, its square body of an insulating material has in its front a plurality of contact housing holes arranged in a matrix form, a socket contact being housed in each contact housing hole. The rear portion of the square body is hollow, open at its rear end but bottomed with a terminal holder made of an insulating material. The contacts have their rear end portions extended into the above-mentioned hollow portion, in which they are bent down to form terminal portions which project out of the terminal holder through holes made therein. The forward portion of the square body is smaller in width and height than its said rear portion, and a stepped portion is provided at the boundary between the forward and rear portions of the square body. A square tubular shield cover made of metal is put on and fixed to the square body, and a square groove which extends from the front of the square body to the above-mentioned stepped portion is defined between the shield cover and the forward portion of the square body for receiving a metal cover of the mating plug. The shield cover has an engagement key protrusively provided thereon for defining the position of engagement with the mating plug. The engagement key has in its top an inward protrusion for anchoring the mating plug.

With the above construction, since the shield cover is exposed, the multiple socket can be mounted in a hole of the side wall of an electronic equipment housing with substantially no gaps, thus providing for improved electromagnetic shielding.

DESCRIPTION OF THE PREFERRED EMBODIMENT

Figure 1:
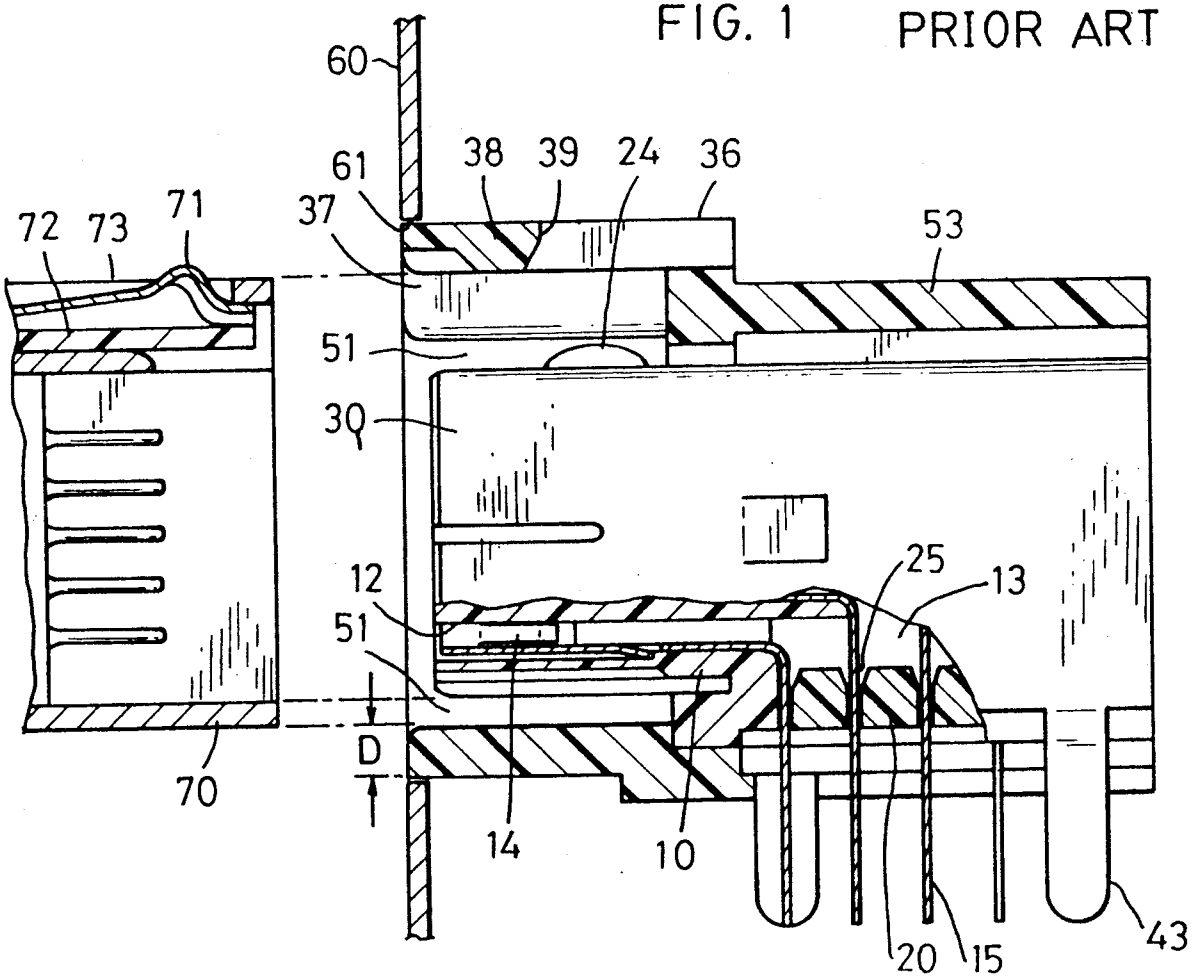
FIG. 1 PRIOR ART
FIG. 1 is a sectional view showing a conventional multi-contact socket and the front end portion of the mating plug.
Figure 2:
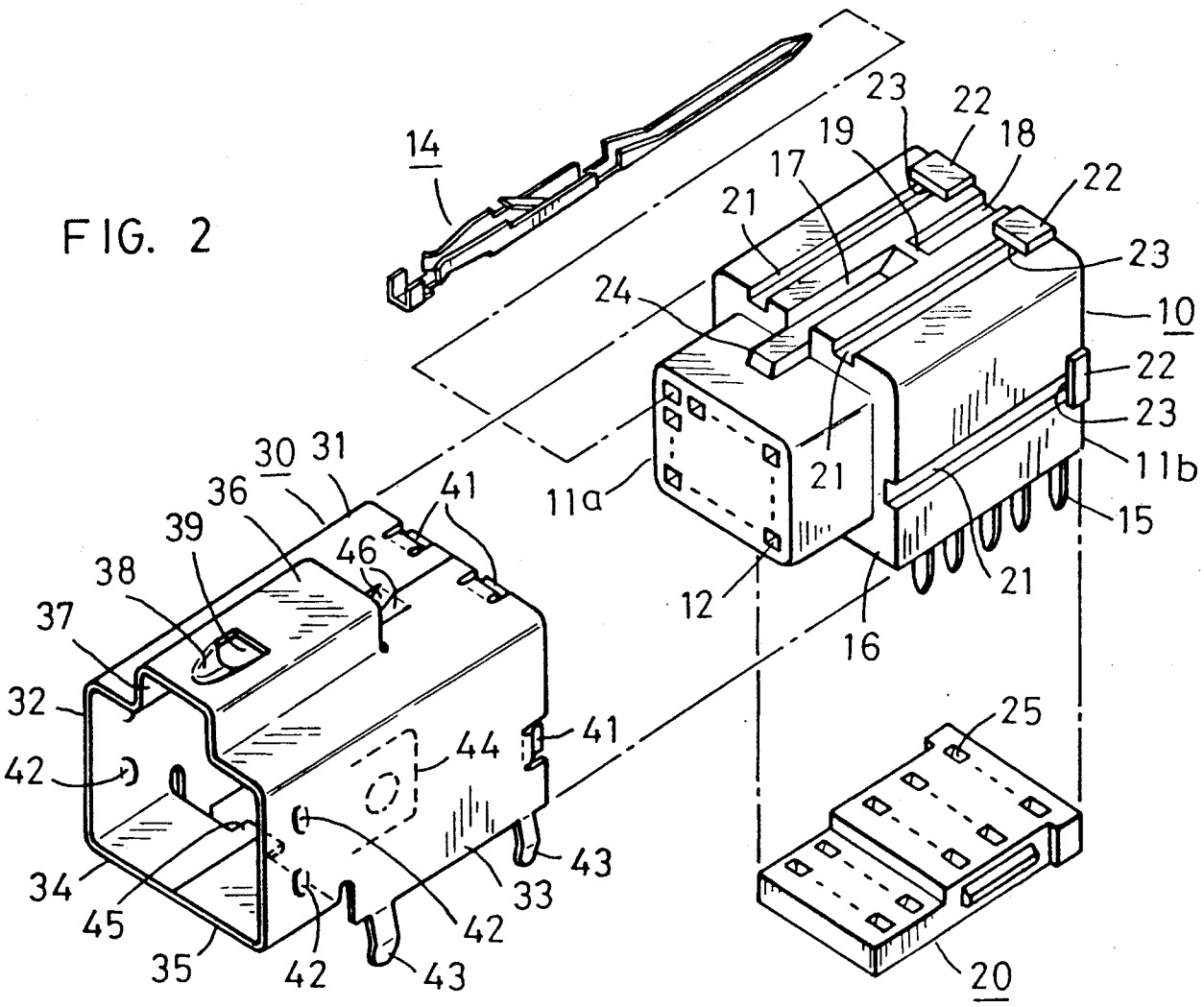
FIG. 2 is a partly exploded diagram illustrating an embodiment of the present invention.

FIG. 2 through 5 illustrate an embodiment of the present invention. A front portion 11*a* of a square body made of an insulating material has a plurality of contact housing holes 12 extending therethrough in the front-to-back direction and arranged in a matric form. A rear portion 11*b* of the body 10 is hollow, and the hollow 13 is open at its rear end but is bottomed with a substantially rectangular terminal holder 20 of an insulating material. The contact housing holes 12 each have housed therein a socket contact 14, the rear end portion of which is bent down in the hollow 13 and led out as a terminal 15 through a terminal insertion hole 25.

The front portion 11*a* of the body 10 is stepped as indicated by 16. In the following description the portion forward of the stepped portion 16 will be referred to as a front body 11*a* and the rear portion including the stepped portion 16 will be referred to as a rear body 11*b*. In the top of the rear body 11*b* there are provided grooves 17 and 18 which extend in the front-to-back direction along the center of the body 10 and are separated by a jetty 19. The depths of the grooves 17 and 18 are about ½ the depth of the stepped portion 16. A protrusion 24 is provided on the top of the front body 11*a* centrally thereof, and the top surface of the protrusion 24 is flush with the bottom of the groove 17. The protrusion 24 is to block the front end of a slider 72 of a lock mechanism of the mating plug (see FIG. 1) and slide back the slider 72; the protrusion 24 corresponds to a projection 24 of the conventional socket shown in FIG. 1. The grooves 17 and 18 are flanked by guide grooves 21 extending in parallel thereto. The guide grooves 21 have their foot ends open to the stepped portion 16 and their rear ends closed with the rear end wall of the body 10. In the vicinity of the rear marginal edge of the body 10, the guide grooves 21 are each covered with a rectangular parallelpipe bridge 22 extending from the rear end wall of the body 10. Engaging recesses 23 are each defined by the bridge 22, the guide groove 21 and the rear end wall. A like guide groove 21 and engaging recess 23 is provided in each side of the rear body 11*b* centrally thereof.

A shield cover 30, which is put on the body 10, is made by punching a sheet of metal into a desired shape and pressing and bending it. The shield cover 30 has a square tubular configuration defined by a top panel 31, side panels 32 and 33 and bottom panels 34 and 35. Cover 30 is open at its front and rear.

The top panel 31 includes an engaging key 36 which has a cross-section of an inverted U-shape and extends rearwardly from the front edge of the shield cover 30, forming a recess 37. In the top of the key 36, an inward protrusion 38 and a through hole 39 are provided side by side in the front-to-back direction. The key 36, the recess 37, the protrusion 38 and the through hole 39 respectively correspond to those parts of the insulating case 53 which are identified by the same reference numerals in FIG. 1. When an engaging key 73 of the mating plug is inserted into the recess 37 of the engaging key 38, the inward protrusion 38 presses down a protrusion 71 of a lock spring, and when the plug is further inserted, the protrusion 71 thrusts into the through hole 39 and the slider 72 slides past the protrusion 24 and into the groove 17, locking the protrusion 71 into the through hole 39 The through hole 39 may be a hole merely resulting from shearing the shield cover 30 to form the inward protrusion 38, or the hole 39 may be omitted. At the rear of the key 36 there is provided a lance 46 which projects into the case for preventing the body 10 from slipping out of the shield cover 30. When the body 10 is inserted into the shield cover 30, the lance 46 passes through the groove 17 and climbs over the jetty 19 into the groove 18, and the tip of the lance 46 is engaged with the jetty 19, thus locking the body 10 and the shield cover 30 to each other. At the rear end edges of the top panel 31 and the side panels 32 and 33, there are formed L-shaped claws 41 which project into the cover 30. When the body 10 is inserted into the shield cover 30, the claws 41 are guided by the guide grooves 21 into the engaging recesses 23, holding the top panel 31 and the side panels 32 and 33 of the shield cover 30 in close contact with the body 10. The shield cover 30 has inward swells 42 formed, as required, to ensure electrical connection with the metal cover 70 of the mating connector (see FIG. 1). The side panels 32 and 33 have fitting legs 43 extending from their lower end edges. To mount the socket on the electronic equipment housing, flanges 44 may also be provided as indicated by the broken lines in FIGS. 3 and 5.

Figure 3:
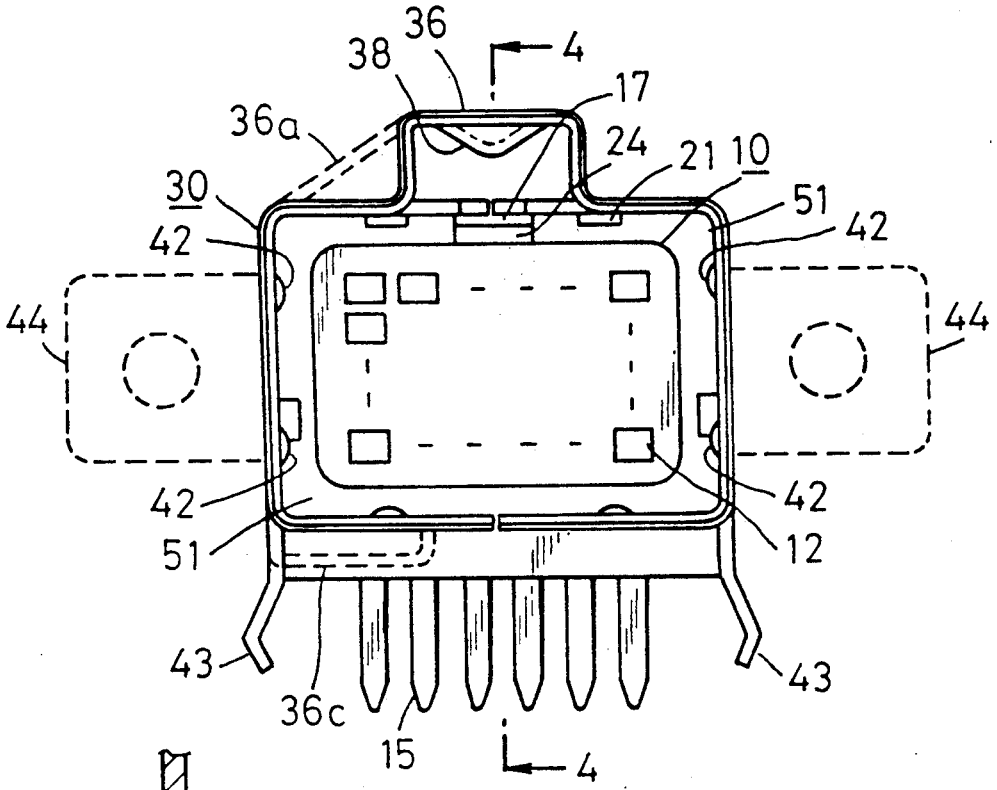
FIG. 3 is a front view of the multi-contact socket depicted in FIG. 2.
Figure 4:
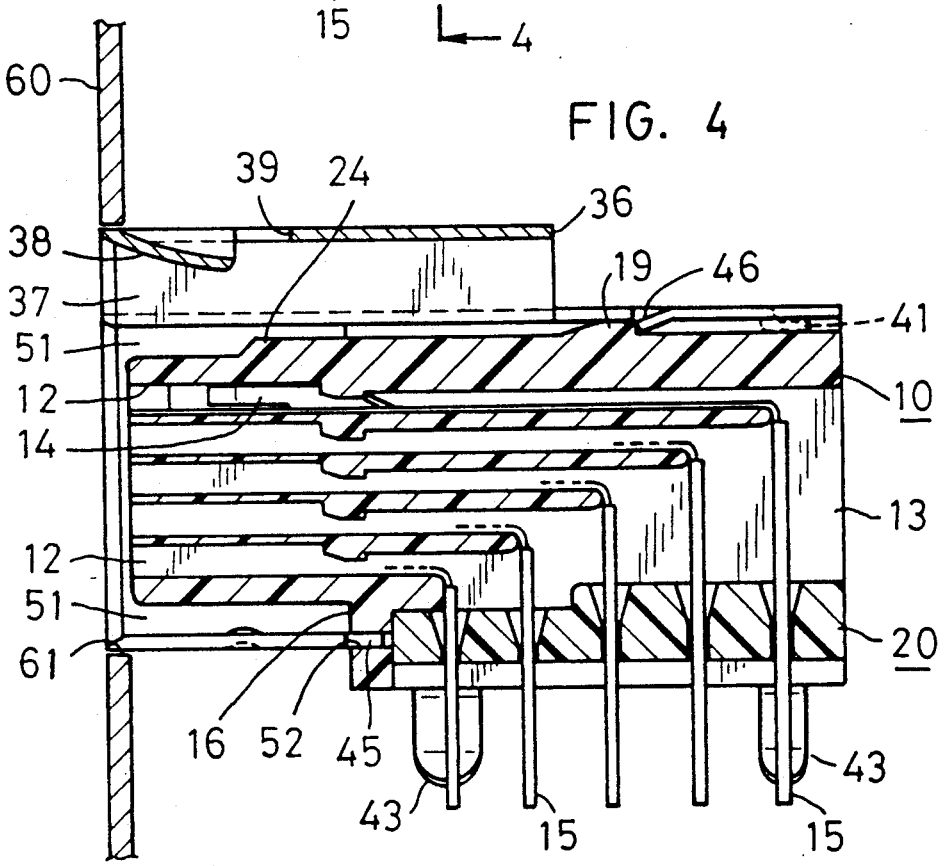
FIG. 4 is a sectional view taken on the line 4—4 in FIG. 3.
Figure 5:
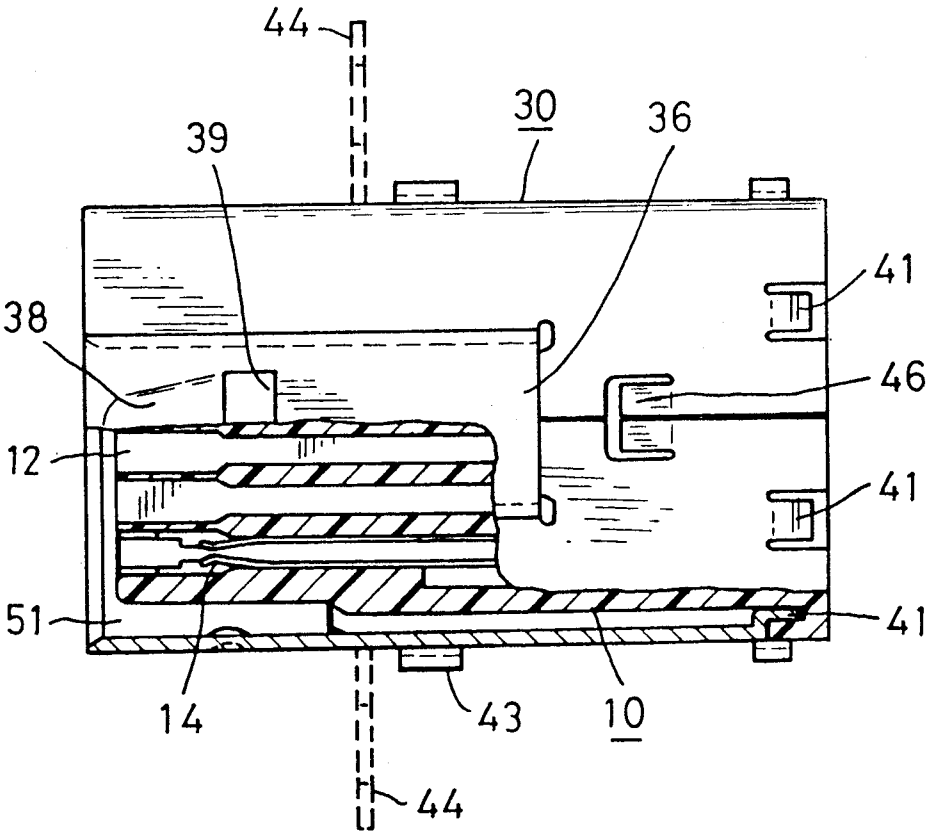
FIG. 5 is a plan view, partly in section, showing the multi-contact socket of the present invention.

The front body 11*a* is smaller than the rear body 11*b* in width and in height so that the stepped portion 16 is formed therebetween, and consequently, when the shield cover 30 is put on the body 10, the shield cover 30 and the front body 11*a* define therebetween a groove 51 which is square as viewed from the front, as shown in FIGS. 3 and 4, and groove 51 extends to the stepped portion 16. The groove 51 receives the square tubular metal cover 70 of the mating plug (see FIG. 1).

The two bottom panels 34 and 35 have their marginal edges held in contact with each other so that they are flush with each other. The stepped portion 16 near the bottom of the body 10 extends down below the bottom panels 34 and 35 at their rear end edges as depicted in FIG. 4. The bottom panels 34 and 35 have lugs 45 projecting out from their rear end edges for engagement with an engaging hole 52 made in the stepped portion 16 of the body 10 (see FIG. 4). This prevents the shield cover 30 of the socket from being spread out when the mating plug is inserted.

One of the side walls 36*a* of the engaging key 36 may also be sloped as indicated by the broken lines in FIG. 3. The key 36 need not always be provided on the top of the shield cover 30 but it may also be provided on the underside of the cover 30 as indicated by reference numeral 36*c*, and a plurality of such keys may be provided on the same plane. It is a matter of course that the mating connector is provided with portions for engagement with such keys. The key 36 not only prevents an accident from happening by connecting a wrong connector but also facilitates connecting a desired connector.

As described above, according to the present invention, since the groove 51 defined between the shield cover 30 and the body 10 receives the metal cover 70 of the mating plug, and since the shield cover 30 is provided with the engaging key 36 having the engaging protrusion 38 for lock use, the shield cover 30 can be inserted closely into the hole 61 of the side wall 60 of the electronic equipment housing. Hence the multi-contact socket of the present invention provides excellent electromagnetic shielding between the inside and outside of the electronic equipment housing. Incidentally, the multi-contact socket of the present invention is made up of only three parts except the socket contacts 14, i.e. the body 10, the holder 20 and the shield cover 30, and hence is advantageous in that the number of parts used is smaller than in the case of the conventional multi-contact socket shown in FIG. 1. Besides, since the engaging protrusion 38 for engagement with the lock spring 71 of the mating plug is formed integrally with the metallic shield cover 30, the engaging portions were less than in the case of the conventional socket, even if the plug and the socket are engaged with and disengaged from each other a large number of times. Accordingly, the multi-contact socket of the present invention maintains the lock mechanism highly reliable for a long period of time.

It will be apparent that many modifications and variations may be effected without departing from the scope of the novel concepts of the present invention.

What is claimed is;

1. A multi-contact socket comprising:

a rectangular body of an insulating material which has a forward portion and a rear portion, said forward portion of said rectangular body being smaller than said rear portion both in width and in height and forming a stepped portion around said body at a boundary between said forward and rear portions thereof, a plurality of contact housing holes extending through said forward portion and arranged in rows and columns, said rear portion of said rectangular body being hollow and said hollow being open at the rear thereof;

a plurality of socket contacts housed in said contact housing holes, rear end portions of said contacts being extended into said hollow and bent down to form terminal portions;

a holder made of an insulating material which holds said terminal portions of said contacts inserted therethrough, said holder being mounted on said body to define a bottom of said hollow;

a rectangular tubular shield cover of metal put on said rectangular body and open at the bottom of the rear portion of said body, forward portions of said shield cover and said rectangular body defining therebetween a square groove for receiving a mating plug;

said rear portion of said body having a groove therein extending rearwardly from said stepped portion, a jetty provided in said groove, said shield cover having a lance formed integrally therewith, said lance being so positioned that when said body is inserted into said shield cover, said lance is guided by said groove and passes over said jetty to lock said shield cover onto said body;

engaging key means protrusively provided on a panel of said shield cover for determining a position of engagement of said socket with a mating plug; and engaging means provided on said engaging key means for locking a mating plug to said socket.

2. A multi-contact socket comprising:

a rectangular body of an insulating material which has a forward portion and a rear portion, said forward portion of said rectangular body being smaller than said rear portion both in width and in height and forming a stepped portion around said body at a boundary between said forward and rear portions thereof, a plurality of contact housing holes extending through said forward portion and arranged in rows and columns, said the rear portion of said rectangular body being hollow and said hollow being open at the rear thereof;

a plurality of socket contacts housed in said contact housing holes, rear end portions of said contacts being extended into said hollow and bent down to form terminal portions;

a holder made of an insulating material which holds said terminal portions of said contacts inserted therethrough, said holder being mounted on said body to define a bottom of said hollow;

a rectangular tubular shield cover of metal put on said rectangular body and open at the bottom of the rear portion of said body, forward portions of said shield cover and said rectangular body defining therebetween a square groove for receiving a mating plug;

said shield cover having a pair of spaced side panels and two bottom panels that are respectively bent inwardly from said side panels, said bottom panels being flush with each other, the rear end edges of each said bottom panel having a claw rearwardly extending therefrom for engagement with an engaging hole made in said stepped portion of said body;

engaging key means protrusively provided on a panel of said shield cover for determining a position of engagement of said socket with a mating plug; and engaging means provided on said engaging key means for locking a mating plug to said socket.

3. A multi-contact socket comprising:

a rectangular body of an insulating material which has a forward portion and a rear portion, said forward portion of said rectangular body being smaller than said rear portion both in width and in height and forming a stepped portion around said body at a boundary between said forward and rear portions thereof, a plurality of contact housing holes extending through said forward portion and arranged in rows and columns, said rear portion of said rectangular body being hollow and said hollow being open at the rear thereof;

a plurality of socket contacts housed in said contact housing holes, rear end portions of said contacts being extended into said hollow and bent down to form terminal portions;

a holder made of an insulating material which holds said terminal portions of said contacts inserted therethought, said holder being mounted on said body to define a bottom of said hollow;

a rectangular tubular shleld cover of metal put on said rectangular body and open at the bottom of the rear portion of said body, forward portions of said shield cover and said rectangular body defining therebetween a square groove for receiving a mating plug;

said shield cover having a pair of side panels, rear end edges of said side panels having L-shaped claws formed integrally therewith, the rear portion of said body having a pair of sides provided with guide grooves at positions corresponding to said L-shaped claws, said guide grooves extending rearwardly from said stepped portion, said body having bridges formed integrally therewith each of which forms a recess for receiving a corresponding one of said claws at the rear end of said guide-groove;

engaging key means protrusively provided on a panel of said shield cover for determining a position of engagement of said socket with a mating plug; and engaging means provided on said socket engaging key means for locking a mating plug to said socket.

4. A multi-contact socket comprising:

a rectangular body of an insulating material which has a forward portion and a rear portion, said forward portion of said rectangular body being smaller than said rear portion both in width and in height and forming a stepped portion around said body at a boundary between said forward and rear portions thereof, a plurality of contact housing holes extending through said forward portion and arranged in rows and columns, said rear portion of said rectangular body being hollow and said hollow being open at the rear thereof;

a plurality of socket contacts housed in said contact housing holes, rear end portions of said contacts being extended into said hollow and bent down to form terminal portions;

a holder made of an insulating material which holds said terminal portions of said contacts inserted therethrough, said holder being mounted on said body to define a bottom of said hollow;

a rectangular tubular shield cover of metal put on said rectangular body and open at the bottom of the rear portion of said body, forward portions of said shield cover and said rectangular body defining therebetween a square groove for receiving a mating plug;

a top panel of said shield cover having two spaced-apart L-shaped claws formed integrally therewith at a rear end edge thereof, said body having guide grooves therein at positions corresponding to said L-shaped claws, said guide grooves extending rearwardly from said stepped portion, said body having bridges formed integrally therewith each of which forms a recess for receiving a corresponding one of said claws at the rear end of said guide groove;

engaging key means protrusively provided on a panel of said shield cover for determining a position of engagement of said socket with a mating plug; and engaging means provided on said engaging key means for locking a mating plug to said socket.

5. The multi-contact socket of one of claims 1, 2, 3 or 4 wherein said engaging means includes an engaging protrusion protruding inwardly from said engaging key.

6. The mutli-contact socket of one of claims 1, 2, 3, or 4 wherein flanges are set up from side panels of said shield cover.

* * * * *